US006735414B2

(12) United States Patent
Shiraishi et al.

(10) Patent No.: US 6,735,414 B2
(45) Date of Patent: May 11, 2004

(54) PAPER EJECTION UNIT IN A PRINT APPARATUS

(75) Inventors: Tatsuya Shiraishi, Ibaraki (JP); Yasushi Hashimoto, Ibaraki (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 0 days.

(21) Appl. No.: 10/196,932

(22) Filed: Jul. 18, 2002

(65) Prior Publication Data

US 2003/0016977 A1 Jan. 23, 2003

(30) Foreign Application Priority Data

Jul. 19, 2001 (JP) ..... P 2001-219826

(51) Int. Cl.[7] ..... G03G 15/00

(52) U.S. Cl. ..... 399/405; 271/213; 271/214; 271/215

(58) Field of Search ..... 399/16, 23, 45, 399/397, 405; 271/207, 213, 214, 215, 217

(56) References Cited

U.S. PATENT DOCUMENTS 4,955,597 A * 9/1990 Johdai et al. ..... 271/215
5,215,300 A * 6/1993 Hiroi et al. ..... 271/213 X
5,318,401 A * 6/1994 Mandel ..... 271/213 X
5,350,169 A * 9/1994 Hiroi et al. ..... 271/213
6,296,247 B1 * 10/2001 Tamura et al. ..... 271/214
6,318,718 B1 * 11/2001 Ogata et al. ..... 271/213

FOREIGN PATENT DOCUMENTS

JP 07-115794 12/1995

* cited by examiner

*Primary Examiner*—Sandra Brase
(74) *Attorney, Agent, or Firm*—McGinn & Gibb, PLLC

(57) ABSTRACT

A paper ejection unit included in a print apparatus for stacking printed paper to provide a print apparatus for making it possible to provide compatibility between large-capacity stacking of short-size paper frequently used and easiness of handling printed paper of large size. Attention is focused on the fact that the weight of paper that can be handled safely is determined by the paper stack height for each paper size, and it is made possible to change the paper stackable amount for each paper size by a paper stack table moved down gradually with an increase in the stack amount of printed paper and a paper stack table height detector for detecting the position of the paper stack table.

18 Claims, 4 Drawing Sheets

PAPER EJECTION UNIT IN A PRINT APPARATUS

BACKGROUND OF THE INVENTION

1. Field of the Invention

This invention relates to a paper ejection unit in a print apparatus which includes the paper ejection unit and a image formation unit.

2. Background Art

Hitherto, when a predetermined table height detector provided in a paper ejection unit in a print apparatus detects a paper stack table moved down with an increase in the stack amount of printed paper, the paper ejection unit has been determined full of paper, the paper stack operation of the paper ejection unit has been stopped, and a message indicating that the paper ejection unit is full of paper has been displayed on an operation section of the image formation apparatus.

For example, in an image formation apparatus using electrophotography, such as a copier or a laser beam printer, a paper ejection unit for stacking paper ejected from the image formation apparatus needs to be compatible with various paper sizes and stack a large amount of paper with the widespread use of a high-speed image formation apparatus compatible with various paper sizes. The sizes of paper most frequently used with the image formation apparatus are short sizes of A4, B5, letter, etc. If 2,000 or more sheets of paper of large sizes of B4, A3, leisure, etc., are stacked in an image formation apparatus having a paper ejection unit capable of stacking 2,000 or more sheets of paper of the short sizes (75 g/m$^2$), the total weight containing a printed paper taking-out cage exceeds 20 kg and thus a problem occurs in handling of the operator.

In JP-B-7-115794, the paper-full stack amount is changed based on paper size information.

In related art, the paper top face is detected for detecting the paper stack amount. However, if print is stopped midway or the apparatus is powered down at the time, a problem remains in paper stack amount detection at the restart time if the paper top face is detected for detecting the paper stack amount.

SUMMARY OF THE INVENTION

It is an object of the invention to solve the above-described problems. Attention is focused on the fact that the weight of paper that can be handled safely is determined by the paper stack height for each paper size, and it is made possible to change the paper stackable amount for each paper size by a paper stack table moved down gradually with an increase in the stack amount of printed paper and a paper stack table height detector for detecting the position of the paper stack table.

DETAILED DESCRIPTION OF THE PREFERRED EMBODIMENTS

Referring now to the accompanying drawings, there is shown a preferred embodiment of the invention.

Figure 1:
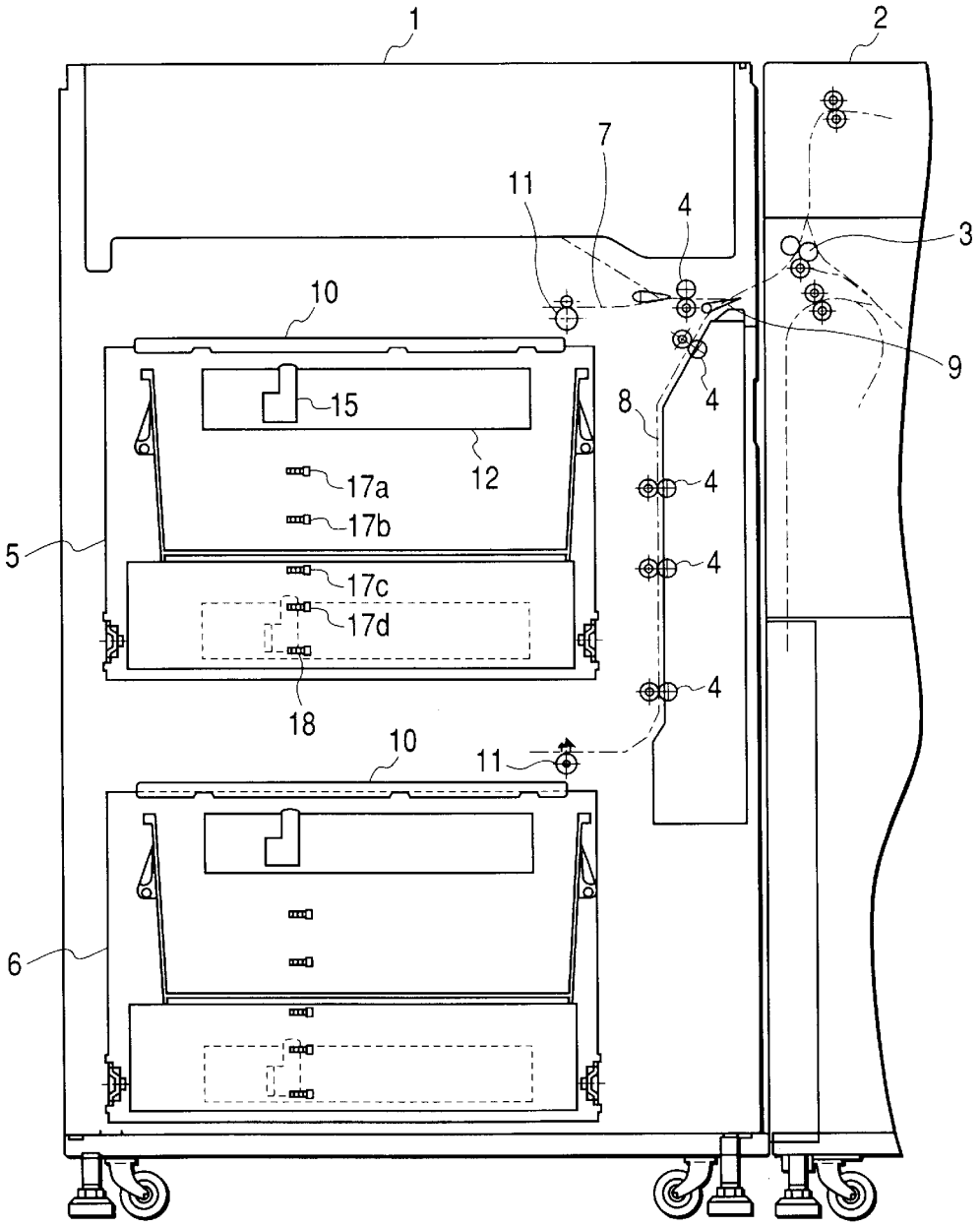
FIG. 1 is a schematic drawing as a front view of a paper ejection unit of the invention.

FIG. 1 is a schematic drawing of a print apparatus. A paper ejection unit 1 is placed at the rear of an image formation apparatus 2 such as a copier or a laser beam printer and comprises transport means 4 for downward transporting paper (cut sheet of paper) sent from an eject roller 3 placed in the image formation apparatus 2, a first paper transport passage 7 for transporting paper to an upper-stage paper stack section 5, a second paper transport passage 8 for transporting paper to a lower-stage paper stack section 6, paper transport passage switch means 9 for switching paper into the first paper transport passage 7 and the second paper transport passage 8, a paper eject roller pair 11 for ejecting paper transported on the paper transport passages 7 and 8 onto paper stack tables 10 placed in the upper-stage paper stack section 5 and the lower-stage paper stack section 6, the upper-stage paper stack section 5, and the lower-stage paper stack section 6. The transport means 4 consists of five pairs of rollers and is placed in the first paper transport passage 7 and the second paper transport passage 8 for transporting paper output from the image formation apparatus 2 to the upper-stage paper stack section 5 and the lower-stage paper stack section 6. A paper stack face detection sensor (not shown) is disposed above each of the paper stack tables 10 in the upper-stage paper stack section 5 and the lower-stage paper stack section 6.

Figure 2:
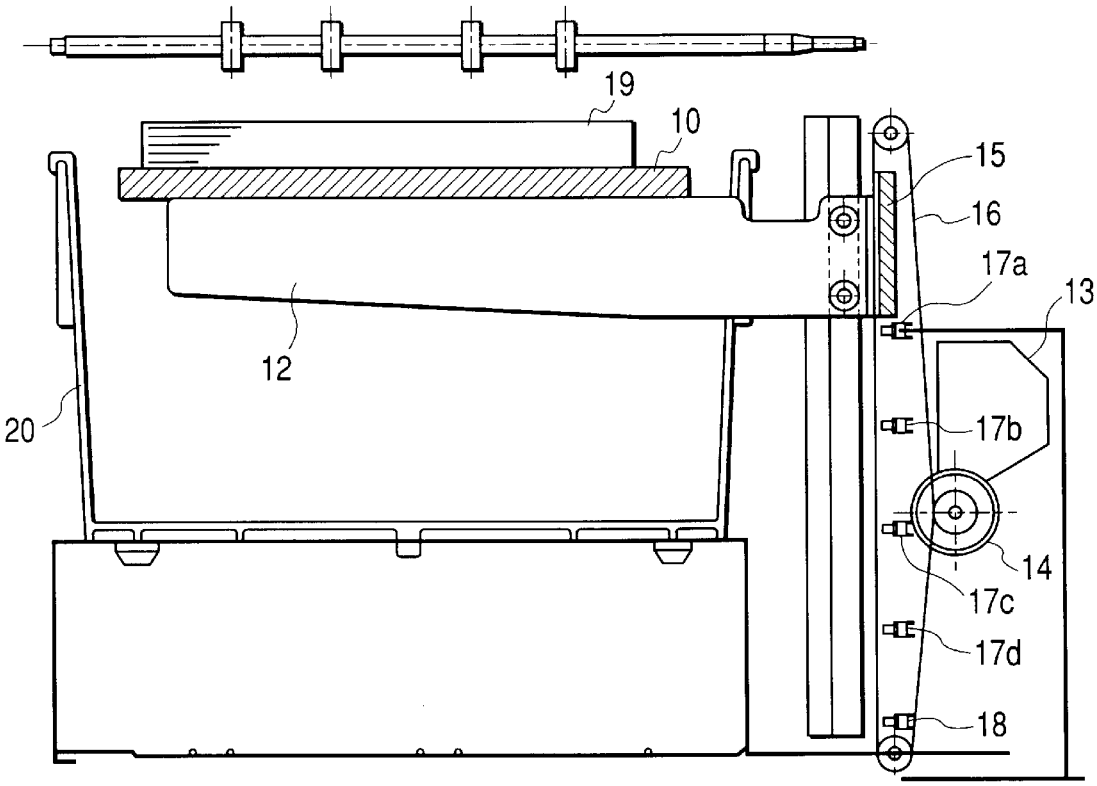
FIG. 2 is a schematic drawing as a sectional side view of the paper ejection unit of the invention.

In the upper-stage and lower-stage paper stack sections 5 and 6, as shown in FIG. 2, a fork 12 on which the paper stack table 10 is mounted is supported movably up and down and is provided with a winding wire 16 connected directly to a paper stack table height detection member 15 for moving up and down by a wire winding gear 14 joined to a motor 13. Further, paper stack table height detection sensors 17*a*, 17*b*, 17*c*, and 17*d* (simply, table sensors) are disposed on the moving up and down line of the paper stack table height detection member 15, and further a lower limit sensor 18 for sensing the lowest down position of the fork 12 is disposed below the paper stack table height detection sensor 17*d*.

Further, as shown in FIG. 2, the paper ejection unit 1 is provided with a printed paper taking-out cage 20 for taking out the printed paper 19 stacked on the paper stack table 10. The size of the printed paper taking-out cage 20 is determined according to the size of paper to be stacked on the paper stack table 10.

Figure 4:
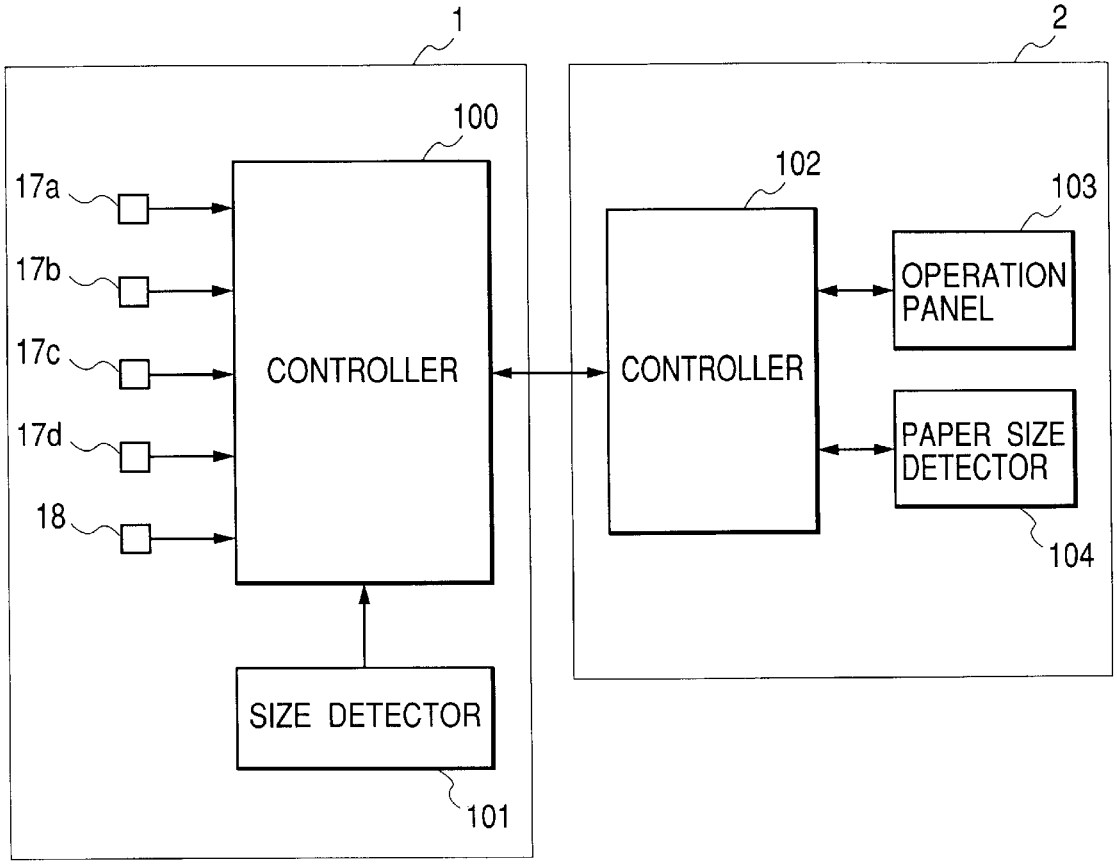
FIG. 4 is a block diagram of the print apparatus of the invention.

FIG. 4 shows the block diagram of the print apparatus in this embodiment. As shown in FIG. 4, the paper ejection unit 1 has a controller 100 and a size detector 101. The controller 100 is connected to the table sensors 17*a*, 17*b*, 17*c* and 17*d* and the lower limit sensor 18. The detection signals of the table sensors are transmitted to the controller 100 to transfer to the image formation apparatus 2. The size detector 101 detects the size of the printed paper taking-out cage 20 and outputs a result of the detection to the controller 100. Then the controller 100 determines the size of the printed paper based on the output from the size detector 101.

The image formation apparatus 2 has a controller 102, and an operation panel 103 for entering information therein. The operation panel 103 is connected to the controller 102 to transmit information thereto. The controller 102 and the controller 100 of the paper ejection unit 1 is mutually connected to receive and transmit data therebetween. Therefore, the information entered at the operation panel 103 can be transmitted to the controller 100 of the paper ejection unit 1.

Further, the image formation apparatus 2 has a paper size detector 104 for detecting the size of the paper to be printed therein. The paper size detector 104 outputs the result of the detection to the controller 102.

Figure 3A:
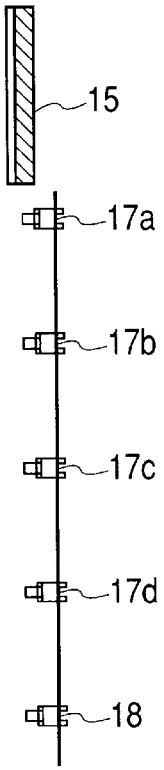
FIG. 3A is a schematic drawing to show paper stack table height detection of the paper ejection unit of the invention.
Figure 3B:
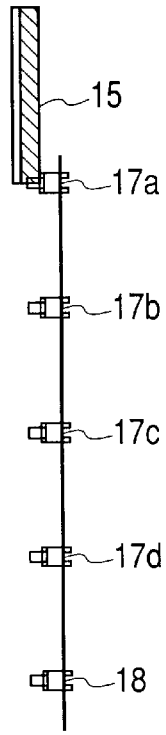
FIG. 3B is a schematic drawing to show paper stack table height detection of the paper ejection unit of the invention.
Figure 3C:
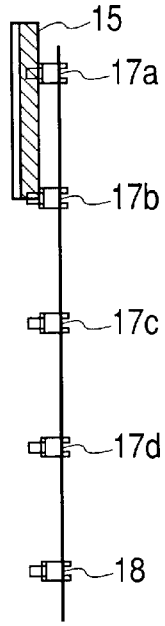
FIG. 3C is a schematic drawing to show paper stack-table height detection of the paper ejection unit of the invention.
Figure 3D:
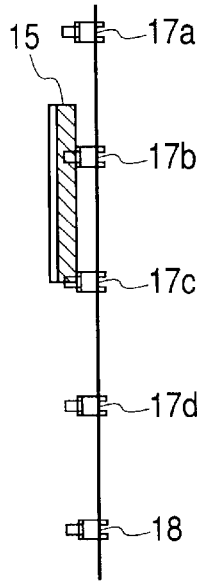
FIG. 3D is a schematic drawing to show paper stack table height detection of the paper ejection unit of the invention.
Figure 3E:
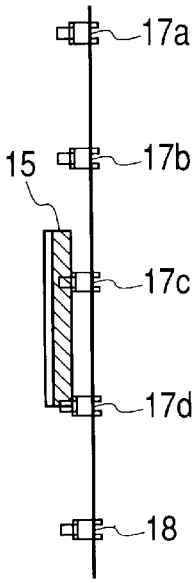
FIG. 3E is a schematic drawing to show paper stack table height detection of the paper ejection unit of the invention.

In the embodiment of the described configuration, as indicated by the position of the paper stack table height detection member 15 in FIGS. 3A–3E, in the state of FIG. 3A, namely, if the paper stack table height detection member 15 is sensed by none of the table sensors, the controller informs the image formation apparatus 2 that the paper stack amount is about 0 to 500 sheets (the number of stacked sheets of paper in terms of 75 g/m$^2$ paper). Likewise, in the state of FIG. 3B, if the paper stack table height detection member 15 is sensed by the table sensor 17*a*, the controller 100 informs the image formation apparatus 2 that the paper stack amount is about 500 sheets; in the state of FIG. 3C, if the paper stack table height detection member 15 is sensed by the table sensor 17*b*, the controller 100 informs the image formation apparatus 2 that the paper stack amount is about 1,000 sheets; in the state of FIG. 3D, if the paper stack table height detection member 15 is sensed by the table sensor 17*c*, the controller informs the image formation apparatus 2 that the paper stack amount is about 1,500 sheets; and in the state of FIG. 3E, if the paper stack table height detection member 15 is sensed by the table sensor 17*d*, the controller 100 informs that the image formation apparatus is informed that the paper stack amount is about 2,000 sheets. If the operator interrupts print or when a fault occurs, if print is restarted without removing all printed paper 19 on the paper stack table 10, the paper table height position is sensed as described above, whereby it is made possible to always inform the image formation apparatus 2 how much paper is stacked in the paper ejection unit.

To print short-size paper, such as A5, B5, A4, or letter paper, in the described configuration, if 2,000 sheets of paper are stacked, the paper weight is 10 kg or less and handling is easy and thus when the paper stack table height detection member 15 is sensed by the table sensor 17*d*, the paper stack amount is set down as the maximum. That is, when the paper stack amount is about 2,000 sheets, and then the image formation apparatus 2 is informed of a paper-full state. To print large-size paper, such as B4, A3, or leisure paper, if a paper-full state is applied when the paper stack amount is 2,000 sheets of paper, the paper weight containing the printed paper taking-out cage 20 exceeds 20 kg and it becomes difficult for the operator to handle. Thus, when the paper stack table height detection member 15 is sensed by the table sensor 17*c*, the paper stack amount is set down as the maximum. That is, when the paper stack amount is about 1,500 sheets, the image formation apparatus 2 is informed of a paper-full state. In the image formation apparatus 2, an algorithm may be adopted wherein if the operator interrupts print and once draws out the paper stack table 10 from the paper ejection unit 1 and then again sets the paper stack table 10, the presence or absence of paper on the paper stack table 10 is detected by a paper presence/absence detector (not shown) and reprint is enabled only if no paper exists. In this case, the maximum paper stack amount may be applied when the count of number-of-ejected-paper-sheets count means (not shown) for counting the number of ejected paper matches a predetermined value after the paper stack table height detection member 15 is detected by the table sensor 17*c* in place of 17*d*. By this, it is also made possible to change the paper stackable amount, and a similar advantage can be provided. The paper stackable amount is changed by a controller 100 or 102 using as a trigger, paper size information provided by a detection signal of a paper size detector 104 placed in a paper feed section of the image formation apparatus 2. In addition to the paper size information provided by the paper size detector 104, paper size information or paper stack amount specification information may be inputted from the operation panel 103 of the image formation apparatus 2 or a host such as a personal computer (not shown), whereby a similar advantage can also be provided. The output of the size detector 101 may be used as the paper size information, whereby a similar advantage can be provided.

As described above, according to the invention, the paper stackable amount of the paper ejection section can be specified based on the paper size information or any desired paper stack amount specification information entered by the operator, so that handling of printed paper can be optimized.

What is claimed is:

1. A paper ejection unit, comprising:

a paper stack table for stacking printed paper transported from an image formation apparatus;

a table moving up and down unit for moving down the paper stack table with an increase in a paper stack amount; and a plurality of detectors for detecting the height of the table, wherein said plurality of the detectors are placed at different positions in a paper stack direction, each of the positions corresponding to said paper stack amount, and wherein said plurality of detectors comprises at least one detector at a position corresponding to said paper stack amount, which outputs a detection signal for determining a paper stack termination.

2. The paper ejection unit as claimed in claim 1, wherein the paper stack amount is specified by an external apparatus.

3. The paper ejection unit according to claim 1, wherein said paper stack amount is variable based on inputted information.

4. The paper ejection unit according to claim 1, wherein said table moving up and down unit comprises a paper stack table height detection member, said paper stack table height detection member comprises said plurality of said detectors.

5. The paper ejection unit according to claim 1, wherein said table moving up and down unit comprises a lower limit sensor for sensing a lowest down position of a fork, said lower limit sensor is disposed below said plurality of said detectors.

6. The paper ejection unit according to claim 1, wherein said paper ejection unit comprises a controller and a size detector, said controller is connected to said plurality of said detectors to receive said detection signal.

7. The paper ejection unit according to claim 1, wherein said table moving up and down unit is other than sensed by said plurality of said detectors, said paper stack amount comprising a range of 0–500 sheets of paper.

8. The paper ejection unit according to claim 1, wherein said detection signal is continuously outputted for determining said paper stack amount.

9. The paper ejection unit according to claim 1, wherein said paper stack amount comprises no more than 2,000 sheets of paper to reach a maximum amount where a paper weight is 10 kg or less.

10. A paper ejection unit, comprising:

a paper stack table for stacking printed paper transported from an image formation apparatus;

a table moving up and down unit for moving down the paper stack table with an increase in the paper stack amount; and a plurality of detectors for detecting the height of the table, wherein said plurality of the detectors are placed at different positions in a paper stack direction, each of the positions corresponding to a predetermined paper stack amount; and when the count of a paper ejection signal after the detection signal of one of the detectors is detected matches a specified value, a paper stack termination is applied.

11. A print apparatus, comprising:

an image formation unit; and a paper ejection unit which stacks printed paper ejected from the image formation unit, wherein the paper ejection unit includes a paper stack table on which the printed paper is stacked, a table moving up and down unit for moving down the paper stack table with an increase in a paper stack amount, and a plurality of detectors for detecting the height of the table, wherein said plurality of the detectors are placed at different positions in a paper stack direction, each of the positions corresponding to said paper stack amount, and wherein said plurality of detectors comprises at least one detector at a position corresponding to said paper stack amount, which outputs a detection signal for determining a paper stack termination.

12. The print apparatus as claimed in claim 11, wherein the image formation unit comprises a paper size detector for detecting paper size in the paper feed section, and wherein the paper stack amount is set based on paper size information from the paper size detector.

13. The print apparatus as claimed in claim 11, further comprising:

an operation panel, wherein the paper stack amount is set based on paper size information entered through the operation panel.

14. The print apparatus as claimed in claim 11, wherein the paper ejection unit comprises a printed paper taking-out cage and a size detector of the printed paper taking-out cage, and wherein the paper stack amount is set based on paper size information from the size detector.

15. The print apparatus as claimed in claim 11, further comprising:

an operation panel, wherein the paper stack amount is entered through the operation panel.

16. The print apparatus comprising a paper ejection unit as claimed in claim 11, wherein the given paper stack amount is set based on paper size information from a host.

17. The print apparatus comprising a paper ejection unit as claimed in claim 11, wherein the paper stack amount is set based on paper stack amount from a host.

18. The paper ejection unit according to claim 11, wherein said image formation unit and said paper ejection unit are connected to receive and transmit information.

* * * * *